US008835814B2

(12) United States Patent
Apetauer et al.

(10) Patent No.: US 8,835,814 B2
(45) Date of Patent: Sep. 16, 2014

(54) DOMESTIC APPLIANCE DEVICE

(75) Inventors: Stefan Apetauer, München (DE); Andreas Hackbarth, München (DE); Tobias Heilmann, München (DE); Detlef Kiel, München (DE); Thomas Möker, München (DE); Gerd Wilsdorf, Olching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 705 days.

(21) Appl. No.: 13/121,434

(22) PCT Filed: Jan. 23, 2009

(86) PCT No.: PCT/EP2009/050763

§ 371 (c)(1),
(2), (4) Date: May 10, 2011

(87) PCT Pub. No.: WO2010/037567

PCT Pub. Date: Apr. 8, 2010

(65) Prior Publication Data

US 2011/0260590 A1 Oct. 27, 2011

(30) Foreign Application Priority Data

Oct. 2, 2008 (DE) ..... 10 2008 042 566

(51) Int. Cl.
*H05B 3/68* (2006.01)
*F24C 7/08* (2006.01)

(52) U.S. Cl.
CPC ..... *F24C 7/083* (2013.01)
USPC ..... 219/443.1; 219/457.1

(58) Field of Classification Search
CPC ... H05B 3/74–3/748; H05B 3/68; F24C 7/08; F24C 7/083; H03K 17/96
USPC ..... 219/443.1–468.2
See application file for complete search history.

(56) References Cited

U.S. PATENT DOCUMENTS

| | | | | |
|---|---|---|---|---|
| 3,711,672 | A | 1/1973 | Moreland, II et al. | |
| 4,233,593 | A | 11/1980 | Bigelow | |
| 5,432,320 | A * | 7/1995 | Scheidler et al. | 219/445.1 |
| 5,528,015 | A * | 6/1996 | von Blanquet et al. | 219/445.1 |
| 6,294,906 | B1 | 9/2001 | Kuechler | |

(Continued)

FOREIGN PATENT DOCUMENTS

| | | |
|---|---|---|
| DE | 10063693 C1 | 8/2002 |
| DE | 10255676 A1 | 6/2004 |

(Continued)

OTHER PUBLICATIONS

English machine—translation of DE 10 2006 048 418, Apr. 2008.*

(Continued)

*Primary Examiner* — Sang Y Paik
(74) *Attorney, Agent, or Firm* — James E. Howard; Andre Pallapies

(57) ABSTRACT

A domestic appliance device is provided which has an operating means carrier that carries operating means. The operating means carrier is formed by a panel and differs from a hob. The operating means carrier also has a functional support surface to absorb at least a part of the weight force of the operating means in a functionally-coupled state.

19 Claims, 6 Drawing Sheets

(56) References Cited

U.S. PATENT DOCUMENTS

| | | | | |
|---|---|---|---|---|
| 6,838,785 | B2 | 1/2005 | Schilling | |
| 7,642,886 | B2 * | 1/2010 | Boss | 335/205 |
| 8,106,733 | B2 * | 1/2012 | Nakasuji et al. | 335/205 |
| 2001/0008237 | A1 | 7/2001 | Essig | |
| 2005/0189820 | A1 * | 9/2005 | Blumenthal et al. | 307/104 |
| 2008/0029369 | A1 * | 2/2008 | Weigold | 200/17 R |
| 2008/0068117 | A1 | 3/2008 | Boss | |
| 2010/0012647 | A1 | 1/2010 | Baier et al. | |

FOREIGN PATENT DOCUMENTS

| | | | | |
|---|---|---|---|---|
| DE | 102006020156 | A1 | | 11/2007 |
| DE | 102006026187 | A1 | | 12/2007 |
| DE | 102006048418 | | * | 4/2008 |
| EP | 0497191 | B1 | | 8/1992 |
| EP | 0844325 | B1 | | 5/1998 |
| EP | 1873609 | A1 | | 1/2008 |
| WO | 2008003572 | A2 | | 1/2008 |
| WO | 2008004372 | A1 | | 4/2008 |
| WO | 2009065704 | A2 | | 5/2009 |

OTHER PUBLICATIONS

Report of Examination EP 09 778 978.8 dated Oct. 16, 2013.

Report of Examination EP 09 778 978.8 dated Apr. 2, 2013.

* cited by examiner

DOMESTIC APPLIANCE DEVICE

BACKGROUND OF THE INVENTION

The invention is based on a domestic appliance device.

A domestic appliance with an operating device is known from DE 10 2006 048 418 A1. The operating device has a recessed frame which forms a panel and into which switches are let. The operating device also has a rotary knob. The rotary knob is supported by a cooking surface with no axis or a shaft and able to be released non-destructibly.

Also known from publication EP 0 497 191 B1 is a cooker control with at least one control element for controlling the cooker. The cooker control features a plate made of magnetically-permeable material, a control element able to be moved on one side of the plate and a magnetic circuit which acts through the plate, with the control element changing the magnetic circuit when moved into a predetermined position. The cooker control also features a sensor arrangement disposed on the other side of the plate for detecting the change in the magnetic circuit, with a guide for the movement path of the control element being provided as a linear or curved guide on the plate.

BRIEF SUMMARY OF THE INVENTION

The object of the invention consists in particular of providing a generic device with improved properties in respect of comfortable usability. The object is inventively achieved by the features of the independent claims and by the features of the subordinate claims, with advantageous embodiments and developments of the invention able to the taken from the subordinate claims.

The invention is based on a domestic appliance device with at least one operating means support unit made up of a panel unit and differing in particular from a hob.

It is proposed that the operating means support unit has at least one functional support surface which is provided to absorb at least a part of the weight force of an operating means in a functionally coupled state. A "functionally coupled state" of an operating means is especially to be understood as an operating state of the operating means in which a user, by actuating the operating means, which particularly involves pressing and/or turning and/or pushing the operating means, can carry out an operating process. A "functional support surface" is especially to be understood as a surface on which the operating means lies in a functionally-coupled state, with a force based on electricity especially able to act on the operating means in said state. A "force based on electricity" should especially be understood as a magnetic force and/or an electrostatic force. "Provided" should especially be understood as specifically equipped and/or designed. Comfortable usability can be achieved with an inventive embodiment. In particular clarity of usability can be achieved.

Preferably the domestic appliance device has at least one cooking surface unit directly adjoined by the operating means support unit. The fact that the operating means support unit "directly" adjoins the cooking surface unit is especially to be understood as there being least one spatial area between the cooking surface unit and the operating means unit which is free from further components. The fact that the spatial area lies "between" the cooking surface unit and the operating means support unit should especially be understood as there being at least one distance which begins at the point of the cooking surface unit and ends at a point of the operating means support unit and which is free of intersection points with components which differ from components of the operating means support unit and from components of the cooking surface unit. This enables a compact design to be achieved.

It is further proposed that the domestic appliance device has at least one cooking surface unit which is arranged at a distance from the functional support surface. This enables comfortable usability to be achieved. In particular a clear overview can be obtained.

Advantageously the domestic appliance device has at least one cooking surface unit which, in at least one operating position, is at least partly lower than at least one part area of the operating means carrier unit. A "cooking surface unit" should in particular be understood as a surface unit on which cooking utensils are arranged during at least one cooking process with a substance which is to be cooked during the cooking process. The fact that the cooking surface unit is "at least partly lower" than a part area of the operating means support unit should especially be understood as, in an operating position of the domestic appliance device, a highest point of the cooking surface unit in respect of a vertical direction being lower than the lowest point of the part area relative to the vertical direction. In this way reliable protection, especially of an operator, can be achieved. In particular protection from liquids boiling over can be achieved.

Preferably the domestic appliance device has at least one control unit which, together with the functional support surface, is intended for setting two or three and/or four and/or at least six cooking zones. A "control unit" is especially to be understood as a unit with a processing unit and/or a memory unit and an operating program stored therein. This enables the device to be controlled in a comfortable manner. In particular savings can be made in components.

It is further proposed that the domestic appliance device feature a panel unit on which the functional support surface is essentially arranged centrally. The fact that the operating means is "essentially arranged centrally" on the panel unit is especially be understood as, in at least one operating state, a mass center point of the operating means being at a distance of less than thirty percent, preferably less than fifteen percent and especially preferably less than five percent of a maximum longitudinal extension of the panel unit from a mass center point of the panel unit. This is designed to achieve an especially high level of operating convenience.

Preferably the domestic appliance device features at least one further functional support surface which is provided together with the control unit for setting at least two cooking zones. This enables an intuitive operability to be achieved. In particular a high level of clarity can be achieved.

Furthermore a domestic appliance device with at least one support unit is proposed which is provided for axle-free, shaft-free and non-destructible releasable support of an operating means, with the support unit at least partly forming at least one operating means support unit which is intended, in at least one operating state, to hold the operating means arranged on the front side relative to at least one horizontal direction of view. Comfortable usability can be achieved with the inventive embodiment. Especially with an oven which has the door arranged on the front, an arrangement of the operating means adjacent to the door can be achieved.

In a preferred embodiment of the invention the domestic appliance device has at least one attachment means which is designed to attach the operating means by means of at least one force based on electricity. This enables a lower cleaning effort to be achieved.

It is further proposed that the domestic appliance device feature at least one operating means support surface which, in at least one operating state, accepts at least a part of the weight force of the operating means and has at least one surface extent direction which in at least one operating state has a non-disappearing vertical component. This enables a compact design to be achieved. In particular a frontal arrangement of the operating means can be achieved. A "non-disappearing vertical component" should especially be understood as a component greater than zero.

A reliable attachment of the operating means can be achieved when the domestic appliance device has at least one operating means support unit which forms the least one receiving area designed for receiving the operating means.

In addition it is proposed that the domestic appliance device has at least one of the operating means and at least one panel unit which is flush with an operating surface of the operating means. This enables the operating means to be attached especially securely.

It is further proposed that the domestic appliance device comprises at least one of the operating means and that the operating means, in a functionally-coupled state, protrudes beyond at least one side contour and/or above the at least one cover surface of the operating means support unit. In this case a "side contour" is to be understood, in the assembled state viewed in a plan view along an axis of rotation of the operating means, as a lateral delimiting line of the operating means support unit and a "surface" is especially to be understood, viewed in the assembled state in a plan view along an axis of rotation of the operating means, as a surface differing from the functional support surface facing towards an observer. In the assembled state the operating means advantageously protrudes in an area at least 1 mm and advantageously at least 2 mm above the side contour and/or above the cover surface. A corresponding embodiment enables an especially advantageous operation of the operating means to be made possible in a part area extending beyond the side contour and/or above the cover surface of the operating means.

Advantageously the operating means in this case, in its functionally coupled state in the radial direction to its axis of rotation at least in the direction of the side contour, is secured by means of the operating means support unit or limited in its movement, and this is preferably done by a contour of the operating means support unit, such as especially preferably by an edge area of the receiving area of the operating means support unit. Preferably the edge area of the support area extends in relation to the axis of rotation of the operating means in its functionally-coupled state over more than 180° and over less than 360°, and/or the receiving area is embodied in at least one area at least partly without an edge area, so that there can be contact between the operating means and a user in this area on its end face side. Furthermore the edge area is preferably embodied in a circular shape which enables advantageous guidance of the operating means to be achieved.

Preferably the domestic appliance device features at least one of the operating means and at least one support unit which supports the operating means rotatably. This enables a higher level of functionality to be achieved.

Advantageously the domestic appliance device features at least one of the operating means and at least one magnetic field generation means which, in a frontal view of the operating means, is arranged at least partly behind the operating means. This enables a precise positioning of the operating means to be achieved.

Furthermore it is proposed that the domestic appliance device has at least one operating means and at least one magnetic field generation means which, in a frontal view of the operating means, is arranged at least partly alongside the operating means. This enables a high level of haptic aptitude to be achieved when attaching the operating means.

Preferably the operating means is able to be dismantled without tools, so that less effort is required to clean it. An especially great deal of effort can be saved if the operating means is dishwasher-safe.

It is also proposed that the operating means support unit is made at least partly of glass. This provides the ability to operate it in a convenient manner.

Further advantages emerge from the description of the drawing given below. Exemplary embodiments of the invention are shown in the drawing. The drawing, the description and the claims contain numerous features in combination. The person skilled in the art would expediently also look at the features individually and combine them into sensible further combinations.

DETAILED DESCRIPTION OF EXEMPLARY EMBODIMENTS OF THE PRESENT INVENTION

Figure 1:
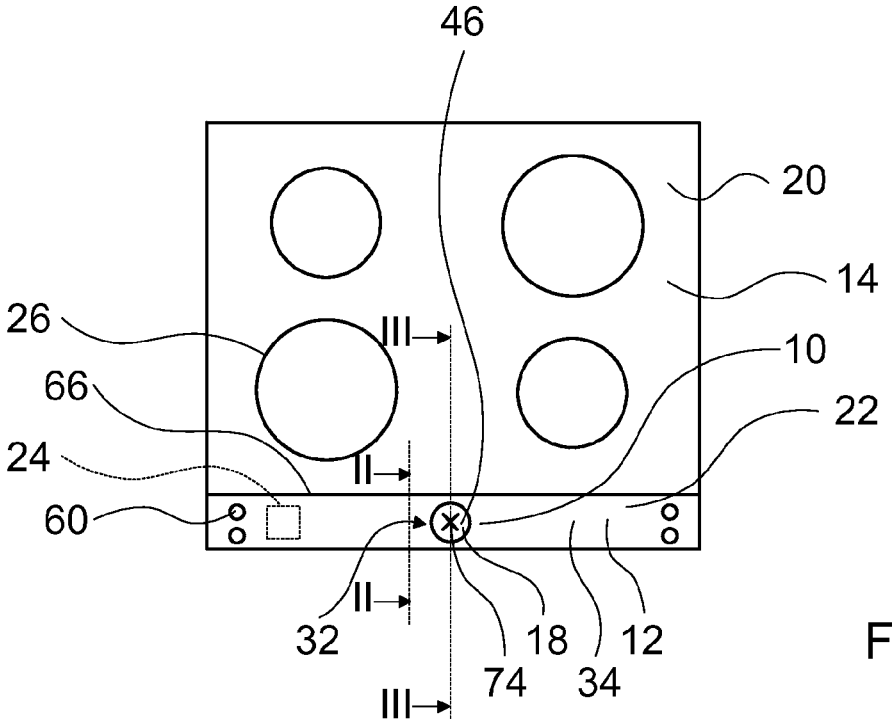
FIG. 1 a plan view of a domestic appliance embodied as a hob device with an inventive domestic appliance device, FIG. 2 a section of a cross section through the domestic appliance device and an adjacent component, FIG. 3 a section of a cross section through a panel unit and an operating means of the domestic appliance device, FIG. 4 a plan view of an alternate embodiment of a domestic appliance device with an alternate exemplary embodiment of an inventive domestic appliance device, FIG. 5 an alternate exemplary embodiment of a domestic appliance with one operating means, FIG. 6 an alternate exemplary embodiment of a domestic appliance with five operating means, FIG. 7 an alternate exemplary embodiment of a domestic appliance with four operating means, FIG. 8 a front view of an alternate exemplary embodiment of a domestic appliance embodied as an oven, with an alternative exemplary embodiment of an inventive domestic appliance device, FIG. 9 a section through the alternate exemplary embodiment of an inventive domestic appliance device, FIG. 10 a section of a plan view of an alternate hob device to that shown in FIG. 1 with a projecting operating means, FIG. 11 a section of a cross section along the line XI-XI in FIG. 10 and FIG. 12 a section of a cross section through an alternate hob device to that shown in FIG. 8.
Figure 2:
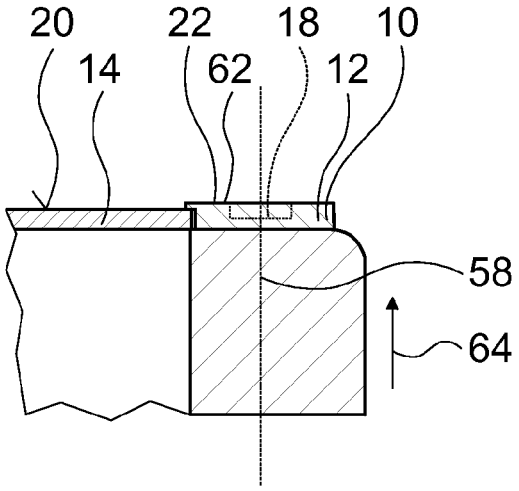
Figure 3:
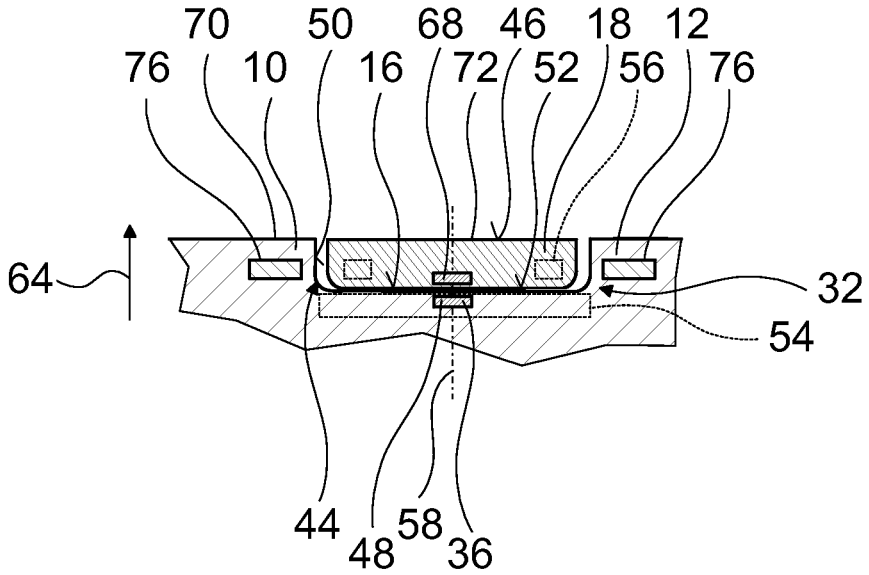

FIG. 1 shows a hob device with an inventive domestic appliance device. The domestic appliance device features a hob 14 with a cooking surface unit 20 formed by a glass ceramic plate, which is designed to accommodate cooking utensils for carrying out a cooking process. Furthermore the domestic appliance device features a panel unit 12 which forms an operating means support unit 10. The operating means support unit 10 adjoins the cooking surface unit 20 directly and differs from the hob 14 or is formed by an element embodied separately from the glass ceramic plate. The operating means support unit 10 forms a receiving area 44 in which an operating means 18 of the domestic appliance device is accommodated (FIGS. 2 and 3). A cylinder jacket-shaped surface 50 of the panel unit 12 extends around the edge of the receiving area 44. Furthermore the operating means support unit 10 has a circular surface area 52 which also extends around the edge of the receiving area 44. In an operating position of the domestic appliance device all directions in which the surface of the circular surface area 52 extends run in parallel to the horizontal.

The surface area 52 forms a functional support surface 16 against which the operating means 18 rests in the operating state. The functional support surface 16 accepts an entire weight force of the operating means 18. Furthermore the domestic appliance device features a support unit 32 which supports the operating means 18 rotatably around an axis of rotation 58. The axis of rotation 58 is parallel to a vertical. In the operating state the operating means 18 is functionally coupled to a sensor unit 54. To this end the operating means 18 has magnets 56 by means of which, in an interaction with Hall sensors of the sensor unit 54, a rotational position of the operating means 18 is able to be established. With the aid of the sensor unit 54 and the magnets 56 it can in particular be established by how many degrees the operating means 18 has been turned relative to a basic position of the operating means 18. The sensor unit 54, as a function of the number of degrees that the operating means 18 has been rotated relative to a basic setting of the operating means 18, in an interaction with a control unit 24 of the domestic appliance device, causes a characteristic variable to be set.

The domestic appliance device has four selection buttons 60 which are assigned to four cooking zones 26 of the hob 14. Pressing one of the selection buttons 60 enables that cooking zone 26 which is assigned to the selection button 60 to be selected. After selection of one of the cooking zones 26, the characteristic variable which is a temperature of the cooking zone 26 is able to be selected by means of the operating means 18. A value of the characteristic variable in this case corresponds to a rotational position of the operating means 18. In this way a temperature value for each of the cooking zones 26 is able to be set. The temperature values are able to be read off on a 7-segment display unit (not shown in the figure).

The cooking surface unit 20 is formed by a glass ceramic plate (FIG. 1). In the operating state the operating means 18 and the functional support surface 16 are arranged at a distance from the cooking surface unit 20. Arranged between the operating means 18 and the cooking surface unit 20 is a raised section 62 of the panel unit 12, which partly forms the receiving area 44.

The operating means carrier unit 10 has a part area 22 which directly adjoins the cooking surface unit 20 along an entire longitudinal side 66 of the cooking surface unit 20 and is higher in the operating state in relation to a vertical direction 64 than the overall cooking surface unit 20. The part area 22, if a liquid overflows onto the cooking surface unit 20, prevents the liquid flowing as far as the operating means 18.

The support unit 32 supports the operating means 18 rotationally (FIG. 3). To this end the support unit 32 features the operating means support unit 10 and an attachment means 36 which is embodied as a magnetic field generation means 48 and is a permanent magnet. In the operating state the magnetic field generation means 48 attracts a permanent magnet 68 of the operating means 18, through which the operating means 18 is attached to the operating means carrier unit 10 and is positioned centrally in the receiving area 44. In a front view of the operating means 18 in the operating state the magnetic field generation means 48 is disposed completely behind the operating means 18. The operating means 18 is attached by means of the magnetic field generation means 48 using a force fit. When the operator exerts a rotational torque on the operating means 18, the operating means 18 is able to be rotated around the axis of rotation 58.

An operating surface 46 of the operating means 18 rests flush against the panel unit 12 (FIG. 3). The panel unit 12 and the operating means 18 both each have a flat upper side 70, 72 which are equal in height in relation to the vertical direction 64 or are arranged in a common plane.

The functional support surface 16 and the operating means 18 are arranged centrally at or on the panel unit 12 (FIG. 1). A mass center point of the panel unit 12 and a mass center point of the operating means 18 are arranged at the same spatial point 74. The panel unit 12 is formed by a metal strip.

Arranged in directions at right angles to the axis of rotation 58 are eighteen magnets 76 along with the operating means 18 within the operating means support unit 10. The magnets 76 interact with the permanent magnet 68 when the operating means 18 is inserted into the receiving area 44, whereby a haptically pleasing attachment of the operating means 18 is achieved. The operating means 18 is supported without a shaft, without an axle and non-destructively and is able to be dismantled without tools. Furthermore the operating means 18 is embodied in the shape of a circle and is able to be cleaned in dishwashers. The panel unit 12, the operating means 18 and the cooking surface unit 20 are distinguished by their different surfaces. The panel unit 12 and the hob 14 are embodied as modules and are thus replaceable.

The panel unit 12 is formed from anodized aluminum. In principle at least the operating means support unit 10 and/or also the panel unit 12 can be made of glass. In the operating state a component is arranged below the panel unit 12 which differs from components of the domestic appliance device.

The operating means 18 is largely made of a plastic. In principle the panel unit 12 can also be made at least partly of a plastic.

Alternate exemplary embodiments are shown in FIGS. 4 to 9. Component features and functions which substantially remain the same are basically labeled with the same reference characters. However to distinguish between the exemplary embodiments, the reference characters of the exemplary embodiments have the letters "a", "b" etc. appended to them in FIGS. 4 to 9. The description below is essentially restricted to the differences from the exemplary embodiments in FIGS. 1 to 3, in which case, in relation to components, features and functions which remain the same, the reader can be referred to the description of the exemplary embodiment in FIGS. 1 to 3.

Figure 4:
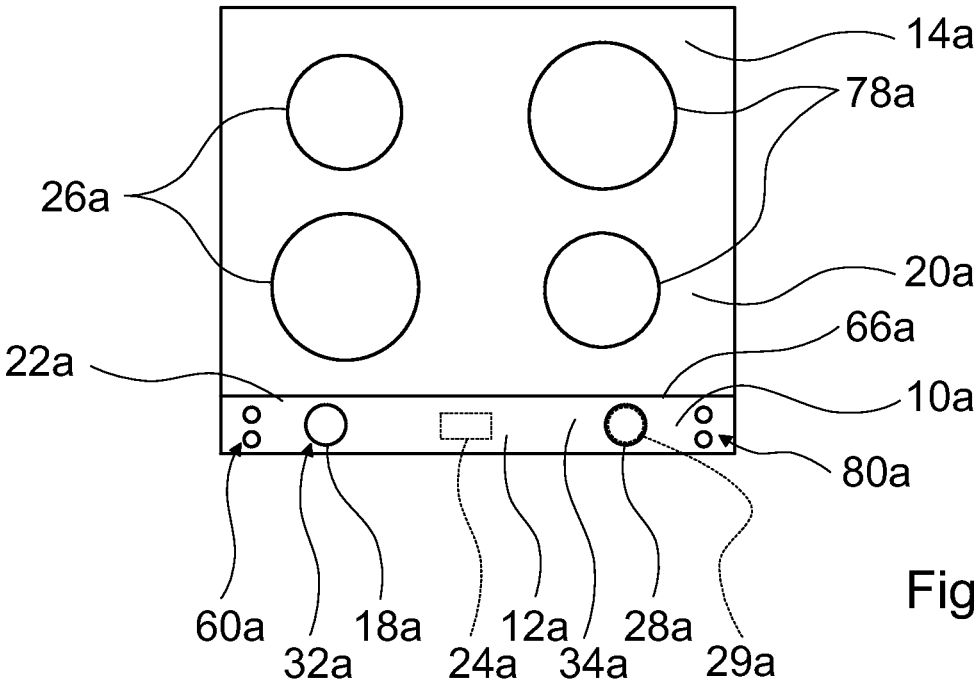

FIG. 4 shows an alternate exemplary embodiment of a domestic appliance device which has an operating means 18*a* and a further operating means 28*a* which are identical in construction and are supported in the same way. The operating means 28*a* rests on a functional support surface 29*a* formed by an operating means support unit 10*a*. Furthermore the domestic appliance device features two cooking zones 26*a* and two further cooking zones 78*a* and selection buttons 60*a*, 80*a*. Cooking temperatures of the cooking zones 26*a* can be selected by means of the operating means 18*a* and a control unit 24*a*. Cooking temperatures of the cooking zones 78*a* can be selected by means of the operating means 28*a* and the control unit 24*a*. The cooking zones 26*a* can be selected by means of the selection buttons 60*a*, the cooking zones 78*a* can be selected by means of the selection buttons 80*a*.

Figure 5:
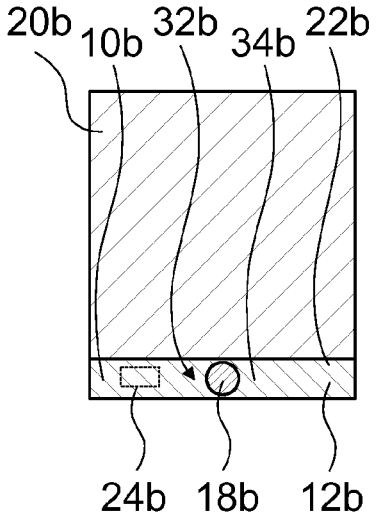

FIG. 5 shows an alternate exemplary embodiment of a domestic appliance device. A color of a cooking surface unit 20*b* differs from a color of an operating means support unit 10*b* and from a color of an operating means 18*b*. Furthermore the color of the operating means support unit 10*b* differs from the color of the operating means 18*b*.

Figure 6:
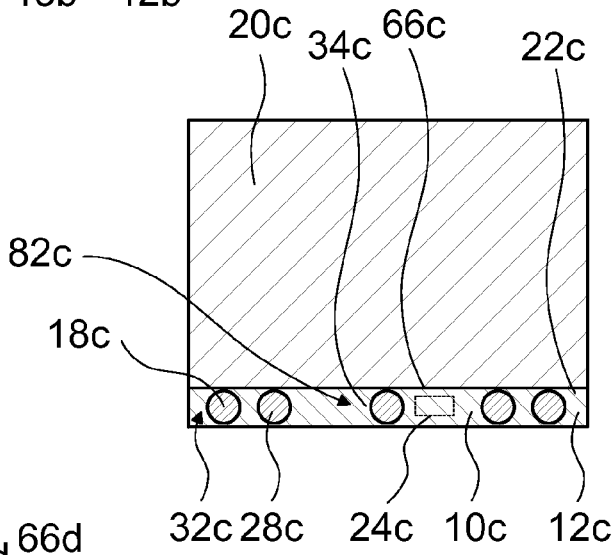

FIG. 6 shows an alternate exemplary embodiment of the domestic appliance device with operating means 18*c*, 28*c* and three further operating means 82*c*. The operating means 18*c*, 28*c*, 82*c* are identical in construction and are each assigned to a cooking zone.

Figure 7:
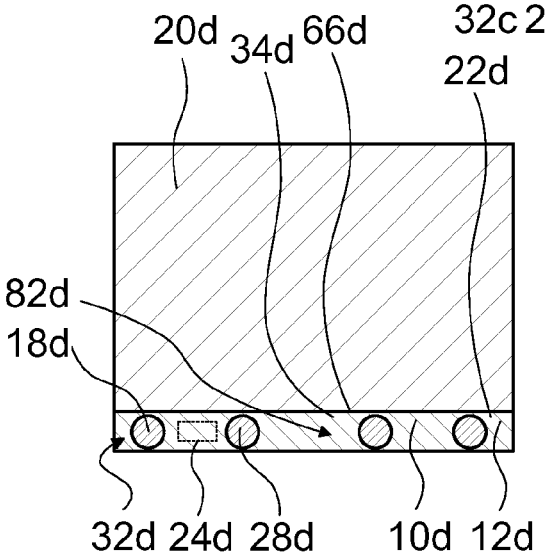

FIG. 7 shows a further alternate exemplary embodiment of a domestic appliance device with operating means 18*d*, 28*d* and two further operating means 82*d*.

Figure 8:
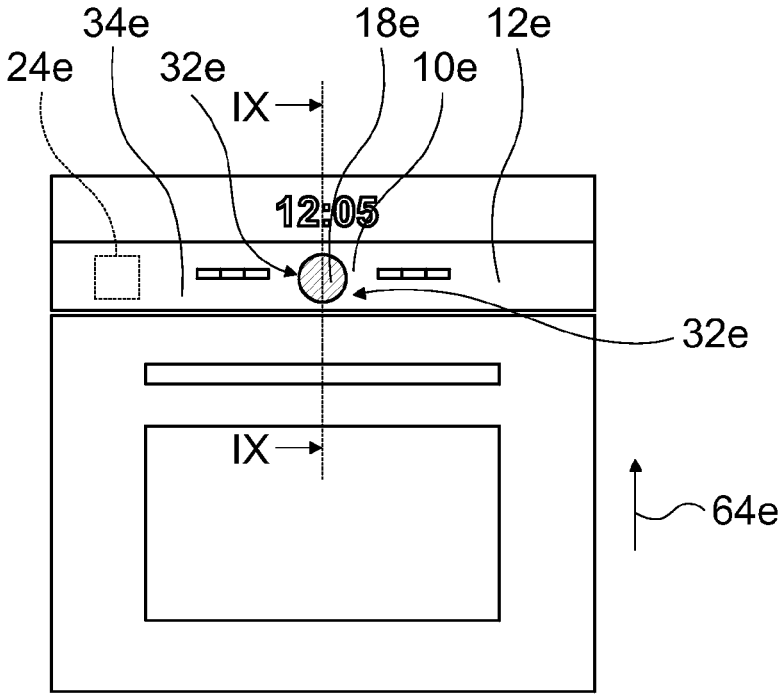
Figure 9:
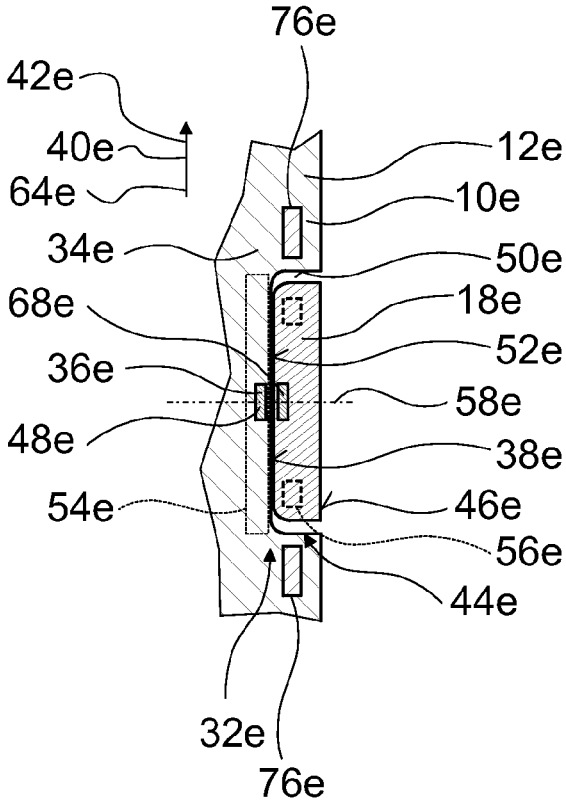

FIG. 8 shows a further alternate exemplary embodiment of a domestic appliance embodied as an oven with an alternate exemplary embodiment of a domestic appliance device. The domestic appliance device features a support unit 32*e* with a magnetic field generation means 48*e* (FIG. 9) which in an operating state supports an operating means 18*e* rotatably. The magnetic field generation means 48*e* attracts a permanent magnet 68*e* of the operating means 18*e*, by which the operating means 18*e* is attached to an operating means support unit 10*e* of the support unit 32*e*. The operating means support unit 10*e* is formed by a panel unit 12*e*. In a front view of the domestic appliance device, in an operating state the operating means 18*e* is arranged on the front and is held by the operating means support unit 10*e*. The operating means support unit 10*e* forms a receiving area 44*e* which is surrounded by a circular-shaped operating means contact surface 38*e* and a cylinder jacket-shaped surface area of the operating means support unit 10*e* at its edge. The operating means 18*e* is arranged in the operating state at a distance from the cylinder jacket-shaped surface area of the panel unit 12*e*. The operating means 18*e* rests on the operating means contact surface 38*e* and is attached to it by a force fit through which the operating means contact surface 38*e* accepts a weight force of the operating means 18*e*. The surface extension direction 40*e* of the operating means contact surface 38*e* is parallel to the vertical direction 64*e* and thus has a vertical component 42*e*. In the assembled state of the operating means 18*e* the panel unit 12*e* is flush against the operating surface 46*e* of the operating means 18*e*.

Figure 10:
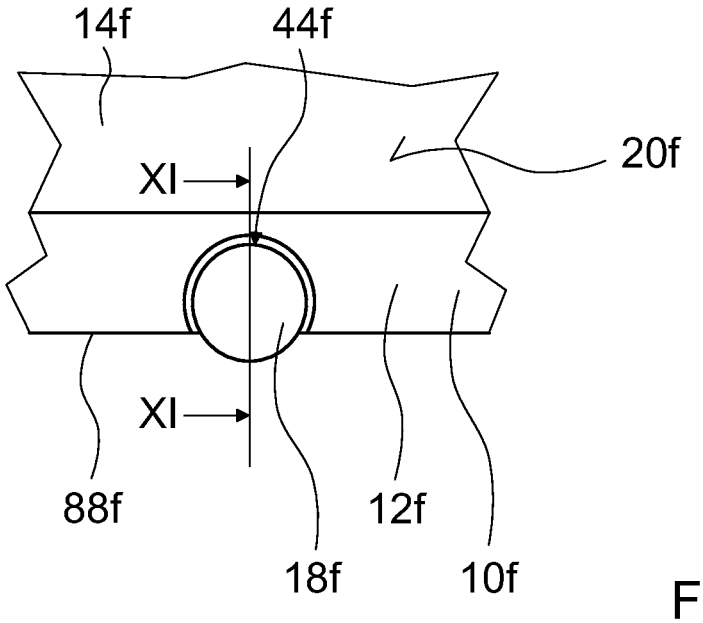
Figure 11:
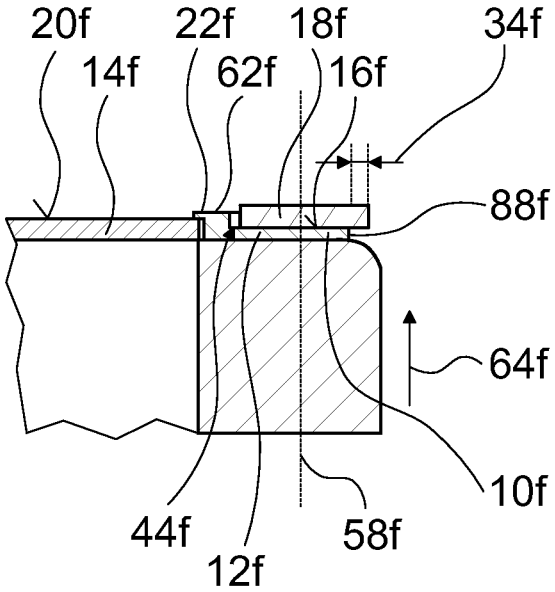

FIG. 10 shows a hob device with an inventive domestic appliance device. The domestic appliance device has a hob 14*f* with a cooking surface unit 20*f* formed by a glass ceramic plate, which is designed to accommodate cooking utensils for carrying out a cooking process. Furthermore the domestic appliance device has a panel unit 12*f* which forms an operating means support unit 10*f*. The operating means support unit 10*f* directly adjoins a cooking surface unit 20*f* and differs from the hob 14*f* or is formed by a unit embodied separately from the glass ceramic plate. The operating means support unit 10*f* forms a receiving area 44*f* formed by a cutout in which an operating means 18*f* of the domestic appliance device is received (FIGS. 10 and 11). The operating means 18*f* projects in a functionally coupled state shown in the diagram beyond a side contour 88*f* and above a cover surface 90*f* of the operating means support unit 10*f* and does so with an extension 34*f* of approximately 2 mm, so that it is possible to operate the operating means 18*f* at its front face side. The side contour 88*f* forms a front edge of the operating means support unit 10*f* facing towards a user standing in front of the hob device. The operating means 18*f*, in its functionally coupled state, is secured in a radial direction to its axis of rotation 58*f* in the direction of the side contour 88*f* by means of the operating means support unit 10*f* or is limited in its movement respectively and this is done by a circular edge area of the receiving area 44*f* of the operating means support unit 10*f*. The edge area of the receiving area 44*f* extends in relation to the axis of rotation 58*f* of the operating means 18*f* over more than 180° and over less than 360°, through which the operating means 18*f* is secured in all radial directions relative to the axis of rotation 58*f* within the receiving area 44*f* or is limited in its movement and advantageous operation is still facilitated at the part area of the operating means 18*f* projecting beyond the side contour 88*f*.

Figure 12:
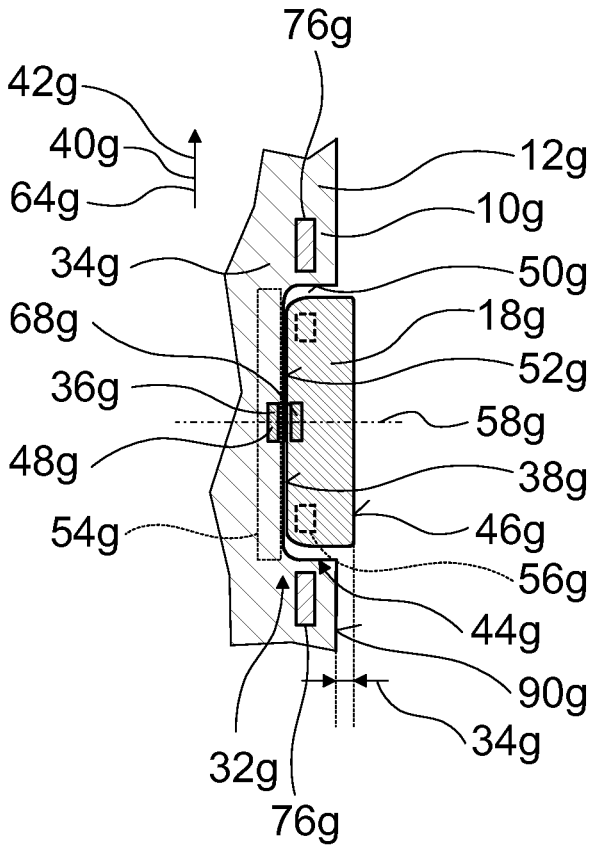

FIG. 12 shows an alternative to the exemplary embodiment in FIG. 8 with an operating means 18*g*, which in a functionally-coupled state shown, protrudes beyond a cover surface 90*g* of an operating means support unit 10*g* and does so with an extension 34*g* of approximately 2 mm, so that operation of the operating means 18*g* at its front face and at its front rounded edge is possible. The cover surface 90*g* is formed by a surface of the operating means support unit 10*g* which runs vertically arranged on a front side.

| Reference characters | |
|---|---|
| 10 Operating means support unit | 62 Raised area |
| 12 Panel unit | 64 Direction |
| 14 Hob | 66 Long side |
| 16 Functional support surface | 68 Permanent magnet |
| 18 Operating means | 70 Upper side |
| 20 Cooking surface unit | 72 Upper side |
| 22 Part area | 74 Space point |
| 24 Control unit | 76 Magnet |
| 26 Cooking zone | 78 Cooking zone |
| 28 Operating means | 80 Selection button |
| 29 Functional support surface | 82 Operating means |
| 32 Support unit | 88 Side contour |
| 34 Extent | 90 Cover surface |
| 36 Attachment means | |
| 38 Operating means contact surface | |
| 40 Surface extent direction | |
| 42 Component | |
| 44 Receiving area | |
| 46 Operating surface | |
| 48 Magnetic field generation means | |
| 50 Surface | |
| 52 Surface area | |
| 54 Sensor unit | |
| 56 Magnet | |
| 58 Axis of rotation | |
| 60 Selection button | |

The invention claimed is:

1. A domestic appliance device, comprising:

an operating means, wherein the operating means is rotatable about a rotation axis and includes a first central magnet coincident with the rotation axis and a first array of magnets spaced radially from the first central magnet and movable with rotation of the operating means;

a sensor for sensing the rotational position of the operating means responsive to movement of the first array of magnets; and an operating means carrier carrying the operating means; wherein the operating means carrier is formed by a panel; wherein the operating means carrier differs from a hob; wherein the operating means carrier has a first functional support surface to absorb at least a part of the weight force of the operating means in a functionally-coupled state; and wherein the operating means carrier includes a second central magnet coincident with the rotation axis for operational engagement with the first central magnet and a second array of magnets spaced radially away from the operating means and the first central magnet and coplanar with the first central magnet for operational engagement of every magnet in the second array of magnets simultaneously with the first central magnet for attachment of the operating means to the operating means carrier in a functionally-coupled state.

2. The domestic appliance device of claim 1, further comprising a cooking surface that is directly adjoined by the operating means carrier.

3. The domestic appliance device of claim 2, wherein the cooking surface is at a distance from the first functional support surface.

4. The domestic appliance device of claim 1, further comprising a cooking surface, which, in at least one operating position, is partly lower than at least a part area of the operating means carrier.

5. The domestic appliance device of claim 1, further comprising a controller to adjust, together with the first functional support surface, at least one of two, three, four, and six cooking zones.

6. The domestic appliance device of claim 5, further comprising a second functional support surface to set, together with the controller, the two cooking zones.

7. The domestic appliance device of claim 1, further comprising a support unit to support the operating means in an axle-free, shaft-free and non-destructive releasable manner, wherein the support unit forms at least partly the operating means carrier; wherein the operating means carrier holds, in an operating state, the operating means; and wherein the operating means are arranged on a front side relative a horizontal direction of view.

8. The domestic appliance device of claim 1, further comprising an operating means contact surface, which, in an operating state, absorbs at least the part of the weight force of the operating means and which has a surface extent direction that has, in the operating state, a non-disappearing vertical component.

9. The domestic appliance device of claim 1, wherein the operating means carrier forms a receiving area to receive the operating means.

10. The domestic appliance device of claim 9 wherein the receiving area defines a recess having a planar floor portion and an upstanding wall portion and the operating means is disposed in the recess abutting the floor portion and spaced from the upstanding wall portion for rotational movement within the recess, and wherein the second array of magnets is carried adjacent the upstanding wall portion for interaction with the first central magnet to form a magnetic cushion between the upstanding wall portion and the operating means.

11. The domestic appliance device of claim 1, wherein the operating means has an operating surface, and wherein the operating means and the panel are flush against the operating surface.

12. The domestic appliance device of claim 1, wherein the operating means carrier has a cover surface; and wherein the operating means projects, in the functionally-coupled state, at least one of beyond a side contour and above the cover surface of the operating means carrier.

13. The domestic appliance device of claim 1, further comprising a support unit to rotatably support the operating means.

14. The domestic appliance device of claim 1, further comprising a magnetic field generator which is, in a frontal view of the operating means, at least partly behind the operating means.

15. The domestic appliance device of claim 1 wherein each magnet in the second array of magnets remain equidistant from the first central magnet while the operating means and the operating means carrier are a functionally-coupled state.

16. The domestic appliance device of claim 1 wherein an operating surface of the operating means and a generally planar upper side of the operating means carrier are coplanar.

17. The domestic appliance device of claim 1 wherein the sensor includes a plurality of magnetic field sensors are mounted within the control panel for operative communication with the first array of magnets to provide control signals for the cooking zones.

18. A domestic appliance comprising a domestic appliance device, the domestic appliance device having an operating means wherein the operating means is rotatable about a rotation axis and includes a first central magnet coincident with the rotation axis and a first array of magnets spaced radially from the central magnet; a sensor for sensing the rotational position of the operating means responsive to movement of the first array of magnets; and an operating means carrier carrying the operating means; wherein the operating means carrier is formed by a panel; wherein the operating means carrier differs from a hob; and wherein the operating means carrier has a first functional support surface provided to absorb at least a part of the weight force of the operating means in a functionally-coupled state; and wherein the operating means carrier includes a second central magnet coincident with the rotation axis for operational engagement with the first central magnet and a second array of magnets spaced radially away from the operating means and the first central magnet and coplanar with the first central magnet for operational engagement of every magnet in the second array of magnets simultaneously with the first central magnet for attachment of the operating means to the operating means carrier in a functionally-coupled state.

19. The domestic appliance device of claim 18 wherein the second array of magnets and the first central magnet are configured to repel one another and thereby form a magnetic cushion between the second array of magnets and the first central magnet.

* * * * *